US007179977B1

(12) United States Patent
Kelly

(10) Patent No.: US 7,179,977 B1
(45) Date of Patent: Feb. 20, 2007

(54) COLORED POLYMER MUSICAL INSTRUMENT MOUTHPIECE

(75) Inventor: James Kelly, Oakfield, WI (US)

(73) Assignee: Superior Solutions Corporation, Fond du Lac, WI (US)

( * ) Notice: Subject to any disclaimer, the term of this patent is extended or adjusted under 35 U.S.C. 154(b) by 0 days.

(21) Appl. No.: 10/735,206

(22) Filed: Dec. 12, 2003

(51) Int. Cl.
*G10D 9/02* (2006.01)

(52) U.S. Cl. ..... 84/398; 84/387 R

(58) Field of Classification Search ..... 84/398, 84/383 R, 380 R, 387 R
See application file for complete search history.

(56) References Cited

U.S. PATENT DOCUMENTS

| | | | | | |
|---|---|---|---|---|---|
| 3,728,929 | A | * | 4/1973 | Sanders | 84/398 |
| 3,750,521 | A | * | 8/1973 | Dolmetsch | 84/380 C |
| 4,395,933 | A | | 8/1983 | Shepley | |
| 4,658,697 | A | | 4/1987 | Wean | |
| 4,754,682 | A | * | 7/1988 | Getzen | 84/382 |
| 4,780,345 | A | | 10/1988 | Gray | |
| 4,784,911 | A | | 11/1988 | Gembinski et al. | |
| 5,353,673 | A | | 10/1994 | Lynch | |
| 5,357,837 | A | * | 10/1994 | Disera | 84/383 R |
| D358,161 | S | | 5/1995 | Kubala | |
| 5,479,842 | A | * | 1/1996 | Ostermeyer | 84/383 A |
| 5,805,264 | A | * | 9/1998 | Janssen et al. | 351/160 R |
| 5,935,691 | A | | 8/1999 | Tsai | |
| 5,969,280 | A | | 10/1999 | Marcinkiewicz | |
| 6,673,992 | B1 | * | 1/2004 | Runyon | 84/383 A |
| 2003/0017311 | A1 | * | 1/2003 | Garitano | 428/195 |

OTHER PUBLICATIONS

Mad-Max, date check included.*
Mad-Max Polycarbonate Mouthpieces brochure Best Products International, Inc. PO Box 723, Jefferson Valley, NY 10535 date unknown.

* cited by examiner

*Primary Examiner*—Lincoln Donovan
*Assistant Examiner*—Jianchun Qin
(74) *Attorney, Agent, or Firm*—Ryan Kromholz & Manion, S.C.

(57) ABSTRACT

A mouthpiece for a brass wind musical instrument is composed solely of a colored polymer material. Its size and shape may be determined by computer coordinate measurements from a conventional metal mouthpiece. The color is chosen to suit the particular purpose of the musician playing the instrument, such as to match the uniforms of a marching band. The mouthpiece is fabricated by injection molding to substantially the desired size and shape. A secondary machining process removes imperfections such as flashings and gate blushes. Alternately, a blank may be injected molded, and the blank machined in a primary machining operation to the desired size, shape, and surface texture. The mouthpiece may also be manufactured by machining a bar of polymer material. The mouthpiece functions in the identical manner as prior metal mouthpieces, but it is much more comfortable to play in cold and hot environments, and it is less costly and more rugged than metal mouthpieces.

4 Claims, 2 Drawing Sheets

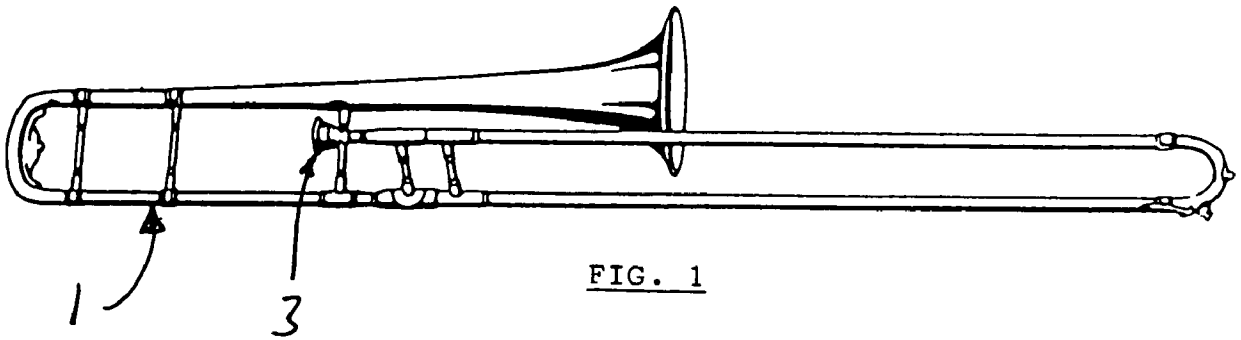
FIG. 1
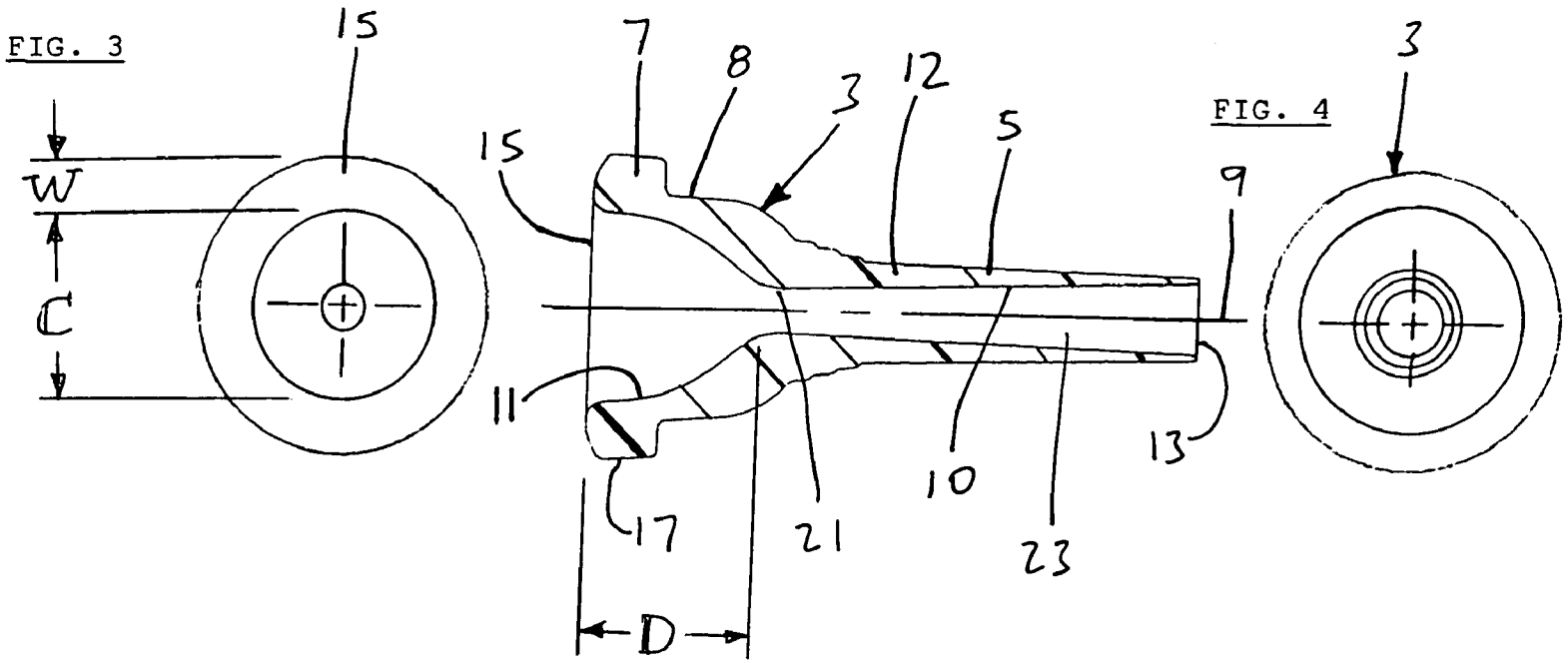
FIG. 2
FIG. 3
FIG. 4

COLORED POLYMER MUSICAL INSTRUMENT MOUTHPIECE

BACKGROUND OF THE INVENTION

1. Field of the Invention

This invention pertains to musical instruments, and more particularly to mouthpieces for brass wind musical instruments.

2. Description of the Prior Art

Various kinds of brass wind musical instruments have been in existence for centuries. They range in size from small cornets to large euphoniums and tubas. Brass wind musical instruments are invariably made from brass material. They may be coated with clear lacquer, in which case the instrument retains its brass color. Some instruments are plated with gold or silver. The different brass instruments produce different notes along the musical scale, as well as different overtones peculiar to the particular instrument.

Every brass wind musical instrument requires an appropriate mouthpiece. The mouthpiece fits into the instrument receiver or leadpipe. The musician presses his lips against the mouthpiece. By properly positioning his embouchure and blowing into the mouthpiece, the lips vibrate. The blown air causes lip vibrations that are transferred via the mouthpiece to the instrument, which produces sounds characteristic of that instrument.

Mouthpieces for brass wind musical instruments are usually made as a single component that is annular in shape and symmetrical about a longitudinal axis. Typical prior mouthpieces may be seen in U.S. Pat. No. 5,969,280 and Des. 358,161. However, multi-component mouthpieces are also known, as is illustrated in U.S. Pat. No. 4,395,933. U.S. Pat. No. 5,353,673 shows a mouthpiece that is asymmetrical about a longitudinal axis.

The DEG Company of Lake Geneva, Wis., manufactures a two-piece musical mouthpiece that has a plastic cup and a metal shank. The surface finish of the cup, which was usually a nylon or Delrin material, was relatively rough compared with metal mouthpiece cups. That disadvantage, plus the expense of manufacturing and assembling two components, limited the popularity of the prior two-material mouthpiece.

Prior brass wind musical mouthpieces were almost always machined from brass and then plated with gold or silver. In addition to being heavy and expensive, the prior metal mouthpieces, especially those with silver plating, could not be used by persons who were allergic to the particular metal.

Another important characteristic of prior mouthpieces was that whatever the material, their colors were generally the same as the color of the instruments, i.e., gold or silver. The mouthpieces thus tended to blend into the instruments.

A common problem with prior metal mouthpieces was that they were susceptible to damage from rough usage. For example, dropping a metal mouthpiece shank on a hard surface required repairs to remove the resulting dents. If a prior metal mouthpiece were dropped on the rim face, the plating was invariably scratched or chipped. Again, the mouthpiece had to undergo expensive replating and repolishing. The cost of repairing a damaged metal mouthpiece was high in relation to its original cost.

U.S. Pat. No. 4,658,697 describes a training mouthpiece for brass wind musical instruments. The mouthpiece of the U.S. Pat. No. 4,658,697 patent has a transparent wall for viewing the musician's lips. The wall has a constant thickness so as to minimize visual distortion. Although suitable for teaching beginning students, the functional shape of the mouthpiece of the U.S. Pat. No. 4,658,697 patent made it impractical for use by advanced musicians.

Despite the wide variety of mouthpieces currently available for brass wind musical instruments, there nevertheless remains room for further developments to them.

SUMMARY OF THE INVENTION

In accordance with the present invention, a comfortable and inexpensive mouthpiece for a brass wind musical instrument is made from a colored polymer material. This is accomplished by molding appropriate quantities of the polymer material and a colorant into a shape suitable as a mouthpiece for a particular conventional musical instrument. A preferred polymer material is polycarbonate.

The dimensional characteristics of the mouthpiece of the invention may be substantially identical to those of conventional prior metal mouthpieces. As a result, from the standpoint of producing musical sounds, the mouthpiece of the invention performs in the same manner as a conventional mouthpiece. On the other hand, the polycarbonate material renders the mouthpiece more comfortable to use than prior metal mouthpieces. Part of the increased comfort comes from the relative softness of the polycarbonate material compared with metal. In addition, the thermal conductivity of polycarbonate is much less than that of metal, thereby rendering the polycarbonate mouthpiece much more comfortable to play in cold or hot environments. The polycarbonate material renders the mouthpiece of the invention practically impervious to damage.

The colorant is chosen to suit an appearance desired by the musician who plays the musical instrument. According to one aspect of the invention, the mouthpiece color contrasts with the color of the instrument. For example, almost all brass wind musical instruments are either brass, gold, or silver in color. To provide distinction to the mouthpiece, and hence to the entire instrument, the musician may choose his mouthpiece to be a color such as red, green, blue, white, or practically any other color that contrasts with brass, gold, and silver. In that manner, the mouthpiece is custom made, and it provides individuality to the musician and his instrument. For example, the color may be chosen to match the color of the uniforms of a marching band. The function of the mouthpiece thus expands from being merely a utilitarian item used solely for producing music to an insignia that identifies the musician and his instrument.

The desireable comfort, cost, and ruggedness properties of the mouthpiece of the invention are independent of its color. Accordingly, a musician who uses a mouthpiece of gold or silver color that blends in with his instrument still obtains the benefits of the other mouthpiece characteristics.

To manufacture the mouthpiece of the invention, molds suitable for the plastic injection molding process are prepared. The proper quantities of polycarbonate material and desired colorant are mixed. Depending on the amount and type of colorant, the finished mouthpiece may be transparent or opaque. The injection molding process may be conventional. Typically, dry pellets of polycarbonate material are heated to the liquid state. The liquid is injected into mold cavities and allowed to cool to a solid state. The solid but incomplete mouthpiece is then removed from the molds.

At the end of the molding process, a secondary machining process is performed on the mouthpiece. The secondary machining removes minor imperfections such as flashings and gate blushes that are typically on the mouthpiece when it is removed from the molds. The secondary machining may include a polishing operation. After the secondary machining process, the mouthpiece is ready to use. That is, the mouthpiece is ready for insertion into the appropriate musical instrument and played in the usual way. However, the colored mouthpiece gives a distinct appearance to the instrument that is unique and that draws favorable attention to the musician and his instrument.

Further in accordance with the present invention, the colored polymer mouthpiece may be molded as a blank. The blank is machined by a primary machining operation to the exact contours and surface texture desired for the finished mouthpiece. In that manner, a single mold can be used to make a variety of different custom mouthpieces.

It is a further feature of the invention that the mouthpiece may be manufactured from a commercially available bar of polymer material. The bar is machined by known machining operations into the desired size and shape. In that way, the need for molding a mouthpiece or a blank is eliminated.

The method and apparatus of the invention, using a colorant with a polymer material, thus provides a comfortable and colored mouthpiece for a brass wind musical instrument. The mouthpiece enhances the individuality of both the musician and his instrument, even though the response of the mouthpiece is substantially identical to that of prior metal mouthpieces having the same size and shape.

Other advantages, benefits, and features of the present invention will become apparent to those skilled in the art upon reading the detailed description of the invention.

BRIEF DESCRIPTION OF THE DRAWINGS

FIG. 1 is a perspective view of a typical brass wind musical instrument that includes the present invention.

FIG. 2 is a cross-sectional view of a typical mouthpiece according to the present invention.

FIG. 3 is a first end view of the FIG. 2.

FIG. 4 is a second end view of a FIG. 2.

DETAILED DESCRIPTION OF THE INVENTION

Figure 8:
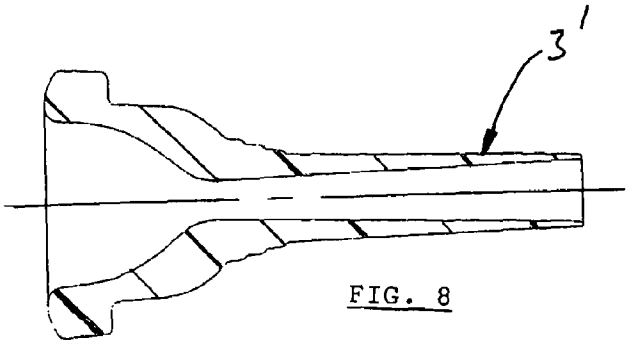
FIG. 8 is a cross-sectional view of a mouthpiece that is produced by machining the blank of FIGS. 5–7.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIG. 1, a typical brass wind musical instrument 1 is illustrated that includes a colored polymer mouthpiece 3 according to the present invention. The particular brass wind musical instrument 1 is a slide trombone. However, it will be understood that the mouthpiece 3 is not limited to use with any particular kind of brass wind instrument. On the contrary, the mouthpiece may be used with a wide variety of brass instruments ranging in size from small cornets to large euphoniums and tubas. The exact size and shape of the mouthpiece will vary according to the particular instrument with which it will be used.

In accordance with the present invention, the mouthpiece 3 is made entirely from a polymer material. Because of its dimensional stability and wear resistance, a preferred polymer material is a polycarbonate plastic material such as is marketed by General Electric Company under the trademark Lean. It is a further feature of the invention that the polycarbonate material includes a colorant that imparts a desired color to the finished colored polymer mouthpiece.

Turning to FIGS. 2–4, the particular colored polymer mouthpiece 3 shown is comprised of a shank 5 and an integral cup 7 that define a common longitudinal axis 9. In turn, the shank 5 and cup 7 are defined by a shank section and a cup section, respectively, of an outer periphery 8 and an aperture 10. The outer periphery 8 and the aperture 10 define a wall 12. The outer periphery and aperture extend between a shank end 13 and a rim face 15. On the cup section of the outer periphery is a rim 17. The cup section of the illustrated aperture has a cup diameter C and a throat 21, which is the smallest area of the aperture. In the shank section of the aperture is a backbore 23. The outer periphery and the aperture at the cup end 15 define a rim width W of the rim face 15. The dimension D in FIG. 2 indicates the cup depth of the cup section of the aperture. The shank section of the outer periphery is invariably tapered toward the shank end 13. A typical taper is a No. 1 Morse taper, i.e., 0.25 inches per foot. Other than the tapered shank, the rest of the outer periphery may vary to suit individual preference.

The colored polymer musical instrument mouthpiece 3 is manufactured in a multi-step process that includes determining the exact desired contours of the outer periphery 8 and the aperture 10. The contours of the cup section of the aperture, including the cup depth D and cup diameter C, may be determined on a computer coordinate measuring machine from a prior metal mouthpiece. Similarly, the dimensional characteristics of the throat 21 and backbore 23 may be determined by computer coordinate measuring. A prototype mouthpiece is tested by professional musicians and revised if necessary until the desired result is achieved.

After the dimensions of the desired colored polymer musical instrument mouthpiece 3 have been determined, complementary steel molds having appropriate cavities and cores are prepared that are suitable for an injection molding machine. Pellets of clear polycarbonate material are loaded into the molding machine and heated to a molten state, as is well known to persons skilled in the art. The liquid material is injected into the molds and cooled. When the molds open, a mouthpiece is ejected.

It is an important feature of the invention that colored polycarbonate pellets are included with the clear pellets. The particular colored pellets and their quantity in relation to the clear pellets can be varied to suit the particular requirements at hand. For example, a ratio of 20 to one of clear to red pellets produces a brilliant cardinal red mouthpiece. Typical other colors are orange, yellow, green, blue, purple, gold, and silver. The colors may be either transparent or opaque, depending on the particular mixture of pellets. Of course, if desired, no colored pellets need be used, in which case the mouthpiece is transparent and colorless.

At the end of the molding process, the mouthpiece 3 usually emerges from the injection molding machine with certain minor imperfections in the surface texture that are inherent in the molding process. For example, there may be very small rings of flashing or gate blushes on the mouthpiece surface. To complete the mouthpiece, a secondary machining process is employed to remove the imperfections. The secondary machining process, which may include polishing and buffing, removes the flashings and gate blushes.

One suitable secondary machining process is gripping the mouthpiece aperture 10 over a rotating mandrel and hand polishing the outer periphery with a grit-impregnated cloth. At the end of the secondary machining process, the colored polymer musical mouthpiece 3 has a completely smooth surface texture and is ready for use. If desired, identifying indicia may be hot stamped or otherwise applied to a selected surface of the mouthpiece.

The colored polymer musical mouthpiece 3 possesses several unique characteristics that render it superior to traditional metal mouthpieces. The polycarbonate material is softer than metal, so a musician finds the mouthpiece of the invention to be more comfortable on his lips. A very important advantage is that the polycarbonate material has a lower coefficient of thermal conductivity than metal. Consequently, the mouthpiece of the invention is more comfortable to play in cold or hot environments. Another advantage concerns cost. Depending on the size, the mouthpiece of the invention costs only about one-third to one-half of comparable metal mouthpieces.

A further benefit of the mouthpiece 3 is that it is practically impervious to damage from rough usage. The resiliency of the polycarbonate material greatly reduces the probability of denting or nicking either the shank 5 or the rim face 15, when, for instance, the mouthpiece is dropped on a hard surface.

An outstanding advantage of the invention is that the mouthpiece 3 exhibits a custom color to suit the preference of the musician using it. For instance, members of a marching band may want their mouthpieces to match the color of their uniforms. In that situation, the band members present a contrasting color scheme consisting of the natural brass or silver color of their instruments plus the color of the uniforms and mouthpieces. The custom coloration is easily achieved by mixing the proper ratio of clear to colored polycarbonate pellets at the start of the injection molding process as discussed above. In that manner, a musician's mouthpiece functions not only to produce musical sounds, but also to express solidarity with the rest of the band. On the other hand, in some instances a musician may want to merely express his individuality by choosing a favorite color for the mouthpiece that does not correlate with any other particular color. Another popular use for the present invention is to correlate the mouthpiece color with a particular event or celebration. For instance, red, white, and blue mouthpieces can be used by different members of a band marching in a Fourth Of July parade. Green and red mouthpieces may be used for a Christmas concert.

In some instances, a musician may want the mouthpiece 3 to blend in with his instrument. In those situations, the musician will use a gold or silver mouthpiece. The other benefits of the mouthpiece such as low cost, durability, and comfort remain available to the musician, because they are independent of the mouthpiece color.

Figure 5:
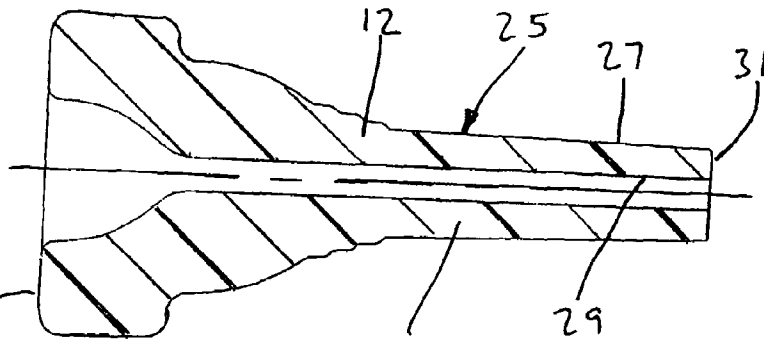
FIG. 5 is a cross-sectional view of a blank from which a mouthpiece of the present invention may be machined.
Figure 7:
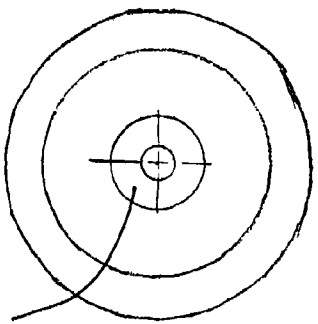
FIG. 7 is a second end view of FIG. 5.
Figure 6:
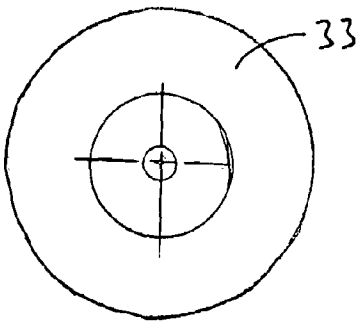
FIG. 6 is a first end view of FIG. 5.

Further in accordance with the present invention, the injection molding machine molds for the mouthpiece need not be prepared so as to produce a mouthpiece that is complete except for the secondary machining process described above that removes flashings and gate blushes. Instead, the molds may be prepared to produce a blank 25 as is shown in FIGS. 5–7. The blank 25 has an outer periphery 27 and an aperture 29 with a rather thick wall 30 between them. The blank preferably has a length between the shank end 31 and cup end 33 that is longer than a normal mouthpiece.

The blank 25 is finished to the desired size and shape of the final mouthpiece 3' of FIG. 8 by a primary machining operation on the blank outer periphery 27, aperture 29, shank end 31, and cup end 33. Typically, the primary machining is done on a lathe using single point tooling, as is well known in the machining arts. Such machining also produces a completely smooth surface texture. The final dimensions of the mouthpiece 3' may be determined by computer coordinate measurements that quantitatively determine the shape and size of a prior metal mouthpiece. In that manner, a musician is able to have a custom made mouthpiece 3' that is identical in shape and size to his favorite metal mouthpiece. The end product mouthpiece 3' may be identical in structure and function to the mouthpiece 3 produced by the molding and secondary machining processes described above. Because of the thickness of the wall 30 and excess length between the shank end and cup end, several different mouthpieces 3' of varying final contours for the outer peripheries and apertures can be obtained from a single blank.

Figure 9:
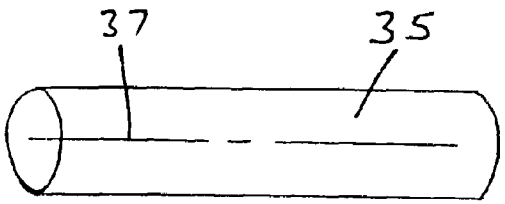
FIG. 9 is a perspective view of a piece of barstock from which the mouthpiece of the invention may be manufactured.

FIG. 9 further demonstrates the versatility of the present invention. Reference numeral 35 indicates a bar of polymer material, which may be solid and round, having an axial centerline 37. The bar 35 is machined by well known machining operations, such as by turning in a lathe, into a completed mouthpiece of the desired size and shape. Custom polymer mouthpieces are thus available by means of computer coordinate measurements taken from a prior metal mouthpiece as previously explained but without requiring any molding of the polymer material.

In summary, the results and advantages of brass wind musical instruments can now be more fully realized. The colored polymer mouthpiece provides both the ability to produce musical sounds in conjunction with an instrument as well as to combine comfort with custom color exhibition. This desirable result comes from using the polycarbonate material for the mouthpiece. The polycarbonate mouthpiece is softer to the lips of a player than a metal mouthpiece, and the polycarbonate material has a smoother surface than prior nylon or Delrin mouthpieces. The mouthpiece is much less susceptible to damage from rough handling than traditional metal mouthpieces. The mouthpiece is produced in a wide variety of colors to suit either individual preferences or to match the colors of uniforms of a marching band or the like. The mouthpiece may be produced by an injection molding process that produces substantially the final size and shape followed by a secondary machining process. Alternately, the mouthpiece may be produced by injection molding a blank and then performing a primary machining operation on the blank to the final size and shape, or by machining the mouthpiece from a piece of polymer barstock.

It will also be recognized that in addition to the superior performance of the mouthpiece of the invention, its construction is such as to be much less costly than traditional mouthpieces. Also, because the polycarbonate material is practically impervious to moisture, fading, and denting, the need for careful handling is eliminated.

Thus, it is apparent that there has been provided, in accordance with the invention, a colored polymer musical instrument mouthpiece that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A polymer musical instrument mouthpiece bounded by a first outer periphery and a first aperture that extend between a rim face and a shank end and that each have a first predetermined size and shape, the mouthpiece being fabricated by molding a mixture of polymer material and a selected colorant material into a blank having a second outer periphery and a second aperture each having a second predetermined size and shape, and by performing a primary machining operation on the blank second outer periphery and second aperture to produce the first outer periphery and the first aperture each of the first predetermined size and shape.

2. The polymer musical instrument mouthpiece of claim 1 wherein the polymer material and the colorant material cooperate to render the mouthpiece opaque.

3. The polymer musical instrument mouthpiece of claim 1 wherein the polymer material and the colorant material cooperate to render the mouthpiece transparent.

4. The polymer musical instrument mouthpiece of claim 1 wherein the mouthpiece is fabricated by machining the blank with single point tooling to have the outer periphery and aperture of the predetermined size and shape.

* * * * *